US010553414B2

(12) United States Patent
Youngner et al.

(10) Patent No.: US 10,553,414 B2
(45) Date of Patent: Feb. 4, 2020

(54) APPARATUS AND METHOD FOR TRAPPING MULTIPLE IONS GENERATED FROM MULTIPLE SOURCES

(71) Applicant: Honeywell International Inc., Morristown, NJ (US)

(72) Inventors: Daniel Youngner, Maple Grove, MN (US); Thomas Ohnstein, Roseville, MN (US)

(73) Assignee: Honeywell International Inc., Morris Plains, NJ (US)

( * ) Notice: Subject to any disclaimer, the term of this patent is extended or adjusted under 35 U.S.C. 154(b) by 113 days.

(21) Appl. No.: 14/752,368

(22) Filed: Jun. 26, 2015

(65) Prior Publication Data

US 2016/0379815 A1 Dec. 29, 2016

(51) Int. Cl.
*H01J 49/06* (2006.01)
*H01J 49/00* (2006.01)

(52) U.S. Cl.
CPC ..... *H01J 49/062* (2013.01); *H01J 49/063* (2013.01); *H01J 49/0031* (2013.01)

(58) Field of Classification Search
None
See application file for complete search history.

(56) References Cited

U.S. PATENT DOCUMENTS 4,105,916 A * 8/1978 Siegel ..... H01J 49/145 250/282
5,206,506 A 4/1993 Kirchner
7,012,250 B1 3/2006 Aksyuk
7,180,078 B2 2/2007 Pau et al.
2003/0089846 A1 5/2003 Cooks et al.
2006/0169882 A1* 8/2006 Pau ..... G12K 1/003 250/281
2006/0186329 A1* 8/2006 Gebhardt ..... H01J 49/0404 250/281
2007/0057172 A1* 3/2007 Wang ..... H01J 49/107 250/281
2007/0114386 A1* 5/2007 Fischer ..... H01J 49/0009 250/288

(Continued)

OTHER PUBLICATIONS

Meyer, et al., "Small-Scale Deposition of Thin Films and Nanoparticles by Microevaporation Sources", Journal of Microelectromechanical Systems, vol. 20, No. 1, Feb. 1, 2011, 7 pp.

(Continued)

*Primary Examiner* — James Choi
(74) *Attorney, Agent, or Firm* — Brooks, Cameron & Huebsch, PLLC

(57) ABSTRACT

Devices, methods, and systems for trapping multiple ions are described herein. One device includes two or more ovens wherein each oven includes a heating element and a cavity for emitting atoms of a particular atomic species from an atomic source substance, a substrate having a number of apertures that allow atoms emitted from the atomic source substance to exit the oven and enter an ion trapping area and wherein each oven is positioned at a different ion loading area within the ion trapping area, and a plurality of electrodes that can be charged and wherein the charge can be used to selectively control the movement of a particular ion from a particular loading area to a particular ion trap location.

20 Claims, 4 Drawing Sheets

(56) References Cited

U.S. PATENT DOCUMENTS

| | | | | |
|---|---|---|---|---|
| 2008/0048113 | A1* | 2/2008 | Franzen | H01J 49/4225 250/292 |
| 2011/0143451 | A1* | 6/2011 | Syka | H01J 49/147 436/173 |
| 2015/0076343 | A1* | 3/2015 | Tolmachev | H01J 49/06 250/290 |

OTHER PUBLICATIONS

Kielpinski, et al., "Architecture for a large-scale ion-trap quantum computer", Nature, vol. 417, No. 6890, Jun. 13, 2002, 3 pp.
Extended Search Report and Written Opinion from related European Application No. 16165878, dated Nov. 14, 2016, 12 pp.

* cited by examiner

APPARATUS AND METHOD FOR TRAPPING MULTIPLE IONS GENERATED FROM MULTIPLE SOURCES

STATEMENT OF GOVERNMENT RIGHTS

This invention was made with Government support under contract: W911NF-12-1-0605, awarded by the U.S. Army. The Government has certain rights in this invention.

TECHNICAL FIELD

The present disclosure relates to devices, systems, and methods for trapping multiple ions.

BACKGROUND

An ion trap can use a combination of electrical and/or magnetic fields to capture one or more ions, for example, using a potential well. Ions can be trapped for a number of purposes, which may include mass spectrometry, research, and/or controlling quantum states, for example. Previous approaches to ion trapping have included trapping one ion of one species in an ion trap.

Other approaches have involved heating and ionizing different atomic species in one ion loading area, and may utilize a single oven for vaporizing multiple ionic species. In these implementations, the loading area includes a mix of ions from both atomic species which can be very difficult to select one species to be placed.

Additionally, the oven can only be used with atomic materials having similar vapor pressures in order to not under or over-heat one or both materials, which can result in, destruction of the material, a smaller quantity of vaporized ions, or ions that are difficult to control. Further, previous approaches may result in an operator being unable to control recently vaporized ions of cooling or logical functions as they collide with each other within the same physical loading area, subsequently changing the photo-kinetic potential of the colliding ions, among other issues.

DETAILED DESCRIPTION

Figure 1:
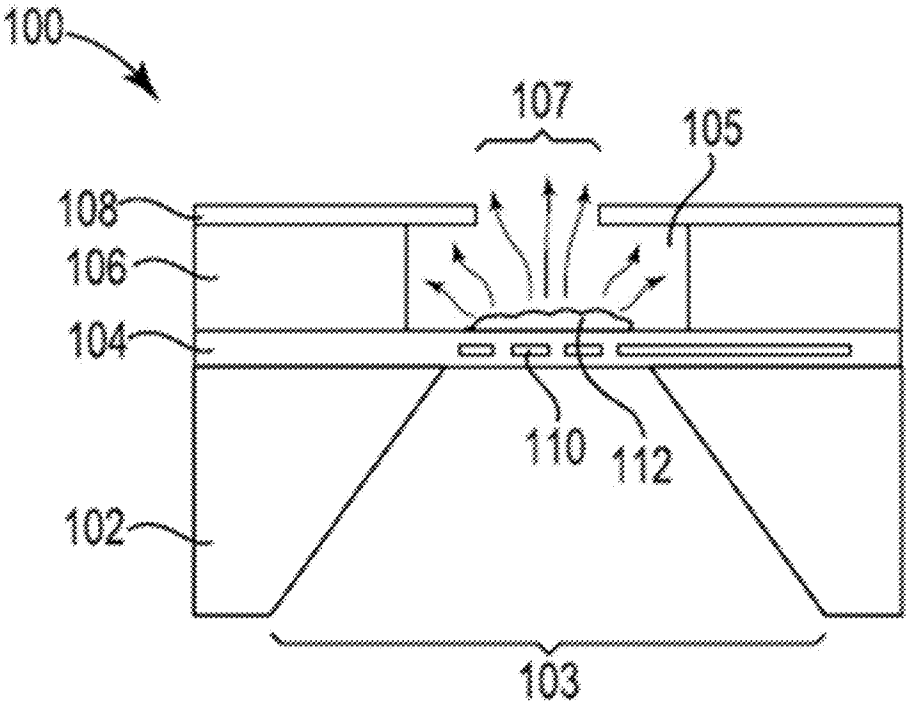
FIG. 1 illustrates an atom emitting oven with a substrate having a number of apertures for emitting atoms of a particular atomic species for ionization in accordance with one or more embodiments of the present disclosure.

Devices, methods, and systems for ion trapping are described herein. In the embodiments of the present disclosure, the ovens are used to each vaporize material of a particular atomic species.

The vaporized material is emitted from the ovens are atoms of that material. The atoms are subsequently ionized and then trapped. This can be done, for example, by photoionization using a laser, among other suitable ionization methods.

One or more embodiments can, for example, include an ion trapping device for trapping multiple ions, comprising multiple ovens wherein each oven includes a heating element and a cavity for emitting atoms of a particular atomic species that are emitted from an atomic source substance and subsequently ionized.

This embodiment also includes, a substrate having a number of apertures that allow atoms emitted from the atomic source substance to exit the oven and enter an ion trapping area. Each oven can be positioned at a different ion loading area within the ion trapping area. In this example embodiment, the ion trapping area includes a plurality of electrodes that can be charged and the charged electrodes can be used to selectively control the movement of a particular ion from a particular loading area to a particular ion trap location.

In such embodiments, multiple atoms emitted from one or more atomic species can be ionized and trapped in accordance with one or more embodiments of the present disclosure by using a plurality of atom emitting ovens and ion loading areas. As a result, ion trapping in accordance with one or more embodiments of the present disclosure can allow easier access to trapped ion(s) of a particular atomic species by optical and/or imaging devices, can also allow an operator better control over ion states within an ion trap (i.e., spin, charge, magnetism) and control over ion state interactions within an ion trap.

In previous approaches, if two atomic source substances are heated at the same temperature and location, some atoms will become too highly charged to effectively manage within an ion trap. Additionally, these ions may interfere with each other's states within the loading area and ion trap. In the present disclosure, the two atomic source substances are physically separated from the time they are heated to the time their emitted atoms are ionized and enter the ion trap area, retaining their initial ion states, reducing cross-atomic species interference, and improving the ability of a particular species to be selected for placement at a particular location.

Embodiments of the present disclosure can include multiple ovens situated at different physical oven locations. These oven locations can include a substrate with one or more apertures leading to an ion loading area near an ion trap location.

In some embodiments, these ovens can be situated beneath an elevated ion loading area. The ion loading area can be used to hold ions until are needed at an ion trap location. The ions can be moved to a particular ion trap location by using a plurality of electrodes of different charges (e.g. neutral, positive, or negative).

Once the ion has moved into the ion trap area, the ion can be moved by a trap operator to a particular location within the trap. Because ion trapping in accordance with one or more embodiments of the present disclosure can be carried out using multiple ovens with multiple corresponding ion loading areas, an operator can separate ions of different types into different loading areas.

Additionally, in some embodiments, an operator can select a particular ion type and can direct them to a specific location within a trap area having multiple trap locations. Further, an operator can take an ion of a first atomic species or atomic number from a first loading area and position it in a first trap location and can then take an ion of a second atomic species or atomic number from a second loading area and position it in a second trap location and in this manner can mix and match ions from the first and second loading areas as needed in the trap area (e.g., some ions may be needed at some locations for cooling and some for logic operations).

By using multiple ovens associated with multiple loading areas in a variety of ion trap arrangements, ion production can be optimized, and ion properties can be more effectively managed within an ion trap area, improving the ability to control ion states and/or placement at a particular location within a trap, compared to previous approaches.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

Directional terms such as "horizontal" and "vertical" "above" and "below" are used with reference to the component orientation depicted in FIG. 1. These terms are used for example purposes only and are not intended to limit the scope of the appended claims.

The figures herein follow a numbering convention in which the first digit or digits correspond to the drawing figure number and the remaining digits identify an element or component in the drawing. Similar elements or components between different figures may be identified by the use of similar digits. For example, 104 may reference element "04" in FIG. 1, and a similar element may be reference as 604 in FIG. 6.

As used herein, "a" or "a number of" something can refer to one or more such things. For example, "a number of apertures" can refer to one or more apertures.

Figure 2:
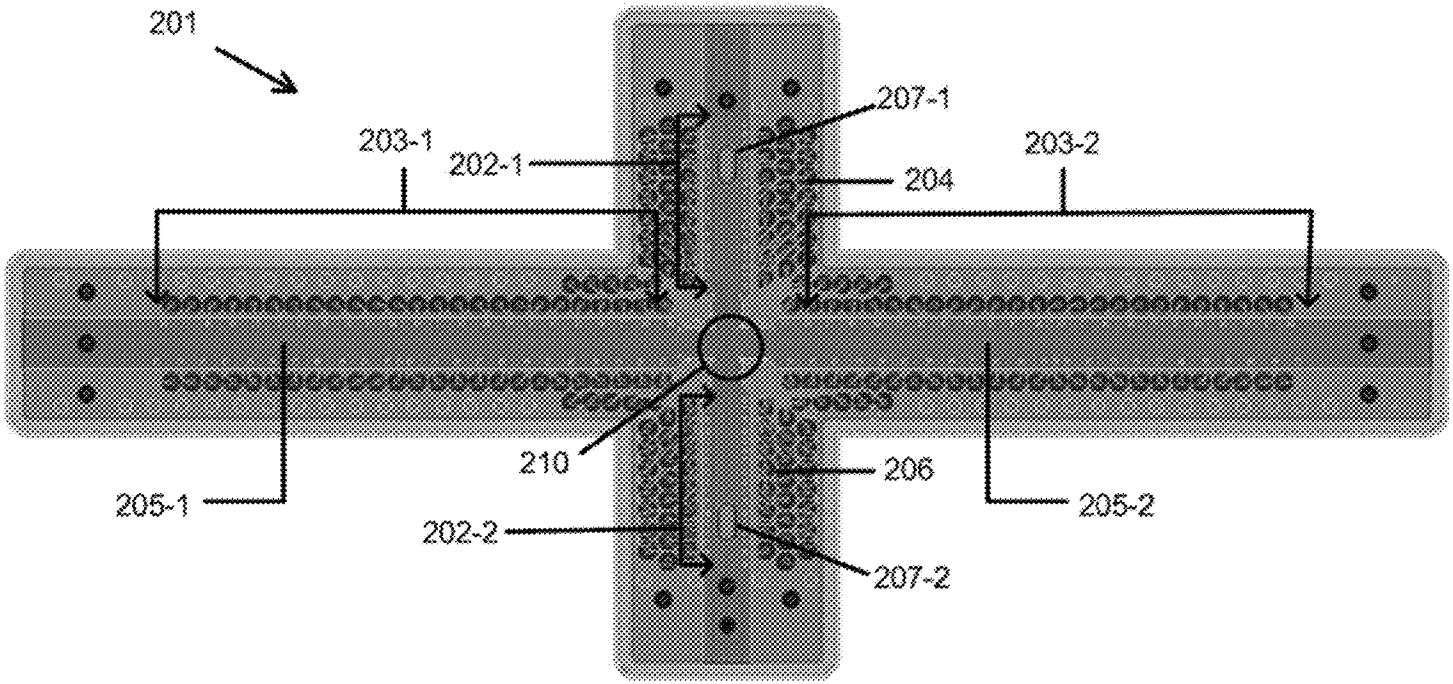
FIG. 2 illustrates a top view of an ion trapping device, including two separate loading areas, selectively charged electrodes, and multiple ion trap locations in multiple different areas in accordance with one or more embodiments of the present disclosure.

FIGS. 1 and 2 illustrate an ion trapping device for trapping multiple ions, comprising multiple ovens wherein each oven includes a heating element and a cavity for emitting atoms of a particular atomic species from an atomic source substance; a substrate having a number of apertures that allow atoms emitted from the atomic source substance to exit the oven and enter an ion trapping area and wherein each oven is positioned at a different ion loading area within the ion trapping area. The trapping area can include a plurality of electrodes or other mechanism for moving the ions from a loading area to a particular trap location. The electrodes can be selectively charged and the charges from the electrodes can be used to selectively control the movement of a particular ion from a particular loading area to a particular ion trap location.

FIG. 1 illustrates an atom emitting oven with a substrate having a number of apertures (in the case of FIG. 1, it has one aperture) for emitting atoms of a particular atomic species in accordance with one or more embodiments of the present disclosure. FIG. 1 illustrates an atom emitting oven that can be used with an ion trapping device embodiment for trapping multiple ions. This embodiment utilizes one oven 100 that is one of multiple (two or more) ovens that includes a heating element and a cavity 105 for emitting atoms of a particular atomic species from an atomic source substance 112 and a substrate 102 having a number of apertures that allow atoms emitted from the atomic source substance 112 to exit the oven 100 and enter an ion trapping area, illustrated in FIG. 2.

Oven 100 of the multiple ovens includes a heating element and a cavity for emitting atoms of a particular atomic species, in accordance with one or more embodiments of the present disclosure. As shown in FIG. 1, the oven 100 includes a substrate 102, a dielectric diaphragm 104, an intermediary material 106 comprising a cavity 105 configured to receive an atomic source substance 112, and a guide material 108, configured to direct vaporized atoms from atomic source substance 112.

Intermediary material 106, as shown in FIG. 1, can be a material comprising a cavity 105 configured to receive an atomic source substance 112 that can have dimensions such that the cavity is adjacent to guide material 108 and dielectric diaphragm 104, as illustrated in FIG. 1. Cavity 105 may be a cavity wherein the cavity includes a substrate for application of an atomic source substance. Such a substrate allows for more effective management of an atomic source substance in one location, in order to maximize heating of an atomic source substance.

Atomic source substance 112 can be any material placed within cavity 105 that can generate atoms when heated to the point of vaporization, as will be further described herein.

Heating element 110 can be configured to heat atomic source substance 112, as will be further described herein. Heating element 110 can be a metal resistive heating element that converts electricity into heat through resistive heating. For example, electric current can be passed through a heating element of heating element 110, and the resistance encountered by the current in the heating element can generate heat.

Although not shown in FIG. 1, dielectric diaphragm 104 can include a number of temperature sensors that can determine the temperature of heating element 110. Temperature sensors can include thermistors, thermocouples, resistance thermometers, or any other suitable type of temperature sensor.

In some embodiments, the temperature of heating element 110 can be controlled by a controller that is part of the oven 100 in order to control the amount of atoms generated from atomic source substance 112 and potential states, as will be further described herein. Additionally, the temperature of heating element 110 can be controlled to prevent the temperature of heating element 110 from becoming too hot and vaporizing the atoms too quickly. The temperature of heating element 110 can also be controlled to prevent the temperature of heating element 110 from not sufficiently vaporizing the atomic source substance 112, reducing available atoms.

As shown in FIG. 1, dielectric diaphragm 104 can be adjacent to intermediary material 106. For example, dielectric diaphragm 104 can be located directly adjacent to intermediary material 106 such that heating element 110 can be adjacent to cavity 105.

Atomic source substance 112 can be located adjacent to heating element 110. For example, atomic source substance 112 can be located in cavity 105 such that atomic source substance 112 can be located adjacent to dielectric diaphragm 104 comprising heating element 110.

In the example shown in FIG. 1, atomic source substance 112 can be a thin-film substance or other form factor, such as a cube or blob of material. In some embodiments, atomic source substance 112 can comprise small granules or powder such that when atomic source substance 112 is deposited in cavity 105, it forms a thin film adjacent to heating element 110.

Heating element 110 can be configured to sublimate atomic source substance 112. As used herein, sublimation refers to a phase transition of a substance directly from a solid phase to a gas phase without passing through an intermediate liquid phase, often called vaporization. For example, heating element 110 can heat atomic source substance 112 so that atomic source substance 112 vaporizes from a solid to a gas. As a result of the vaporization of atomic source substance 112, atoms can be generated from atomic source substance 112.

As shown in FIG. 1, a guide material 108 can be configured to direct vaporized atoms from atomic source substance 112. Guide material 108 can be any material that is compatible with the manufacturing process of oven 100.

Guide material 108, including channel 103, can be adjacent to intermediary material 106 and have an aperture 107 to allow the atoms from atomic source substance 112 to exit the oven 100. As shown in FIG. 1, a cavity 105 may be configured to include guide material 108, wherein the cavity further includes a guide material configured to direct the emitting atoms of a particular atomic species to the substrate having a number of apertures.

For example, opening 107 can direct the atoms resulting from vaporization of atomic source substance 112. That is, opening 107 can be selected to direct the vaporized atoms from atomic source substance 112 in a directional manner. Although sidewalls of channel 103 are shown in FIG. 1 as having a slope, embodiments of the present disclosure are not so limited.

Substrate 102, in the example shown in FIG. 1, can be a base material upon which oven 100 is constructed. Substrate 102 can be adjacent to dielectric diaphragm 104 and include a number of apertures (in this example, channel 107) that allow atoms emitted from the atomic source substance to exit the oven and enter an ion trapping area. For example, substrate 102 can be located directly adjacent to dielectric diaphragm 104. In some embodiments, such as that shown in the embodiment illustrated in FIG. 1, material has been removed below the diaphragm 103. One benefit of removing the silicon below the diaphragm 103 can be to thermally isolate the diaphragm and allow operation with less power that if the material was not removed.

In some embodiments, operation of oven 100 can take place under vacuum conditions. For example, atomic source substance 112 can be heated to vaporize atoms under a vacuum. However, embodiments of the present disclosure are not so limited. For example, operation of oven 100 can take place under partial vacuum conditions or under atmospheric conditions.

The atom vaporization can be controlled by controlling a current supplied to heating element 110. That is, the quantity of the emittance of atoms can be controlled by current supplied to a heating source within heating element 110. For example, a current (e.g., 100 milliamps) can be supplied to heating element 110 to produce a quantity of vaporized atoms from atomic source substance 112. A larger current (e.g., 200 milliamps) can be supplied to heating element 110 to produce a larger quantity of vaporized atoms from atomic source substance 112.

FIG. 1 may illustrate one oven unit, but multiple oven units could be used in an ion trapping device for trapping multiple ions. In particular, the device can include multiple ovens (i.e., two or more), wherein each oven includes an independent controller for controlling the temperature of that particular oven. Such a controller may be analog or digital, locally or remotely managed, or integrated into a separate device which may control multiple ovens, independently, among other implementations.

The device may also include multiple ovens wherein a first oven of the multiple ovens is controlled to reach a higher vaporization temperature than a second oven of the multiple ovens. The ability to manage oven temperatures independently allows a controller to set each oven at a different temperature, a temperature which may increase or decrease the number of atoms emitted of a particular atomic source substance.

FIG. 2 illustrates an ion trapping device for trapping multiple ions comprising a location where multiple ovens, such as those of FIG. 1 are positioned, each at a different atom loading area 202-1 and 202-2 within the ion trapping area 201. FIG. 2 also illustrates that the trap area 201 includes a plurality of electrodes 204 and 206 that can be charged and wherein the charges can be used to selectively control the movement of a particular ion from a particular loading area (e.g., 202-1) to a particular ion trap location (e.g., 205-1).

In the embodiment of FIG. 2, a junction 210 can be used to direct ions of both types to many ion trapping locations. For example, the embodiment of FIG. 2 includes a body having two branches 203-1 and 203-2 each having multiple ion trapping locations (e.g., one branch includes trap location 205-1 among many others and a second branch includes trap location 205-2 among many others).

Device 201, depicted within FIG. 2, positions two or more of ovens, such as those in FIG. 1's system 100, proximal to FIG. 2's two or more loading areas 202-1 and 202-2. For example each loading area, can have its own oven or multiple ovens.

Device 201 in FIG. 2 includes two or more ion loading areas, 202-1, 202-2, which each allow atoms (e.g., from substance 112) to pass through an opening 207-1, 207-2 (e.g., opening 107) of multiple ovens (e.g., ovens such as oven 100 in FIG. 1) to enter the ion loading areas 202-1 and 202-2.

In some embodiments, a first oven (FIG. 1's oven 100) of the multiple ovens may be used for vaporizing atomic species with cooling properties. The first oven is positioned proximate to atom loading area. In the embodiment of FIG. 2, the oven is located below the loading area 202-1 and the atoms enter the loading area 202-1 via the opening 207-1.

In some embodiments, a second oven may be used for vaporizing atomic species to perform logic functions. The oven is positioned proximate to atom loading area. In the embodiment of FIG. 2, the oven is located below the loading area 202-2 and the atoms enter the loading area 202-2 via the opening 207-2.

The ability to use different ovens in conjunction with different atomic species may provide enormous advantages. For example, each atomic species can be vaporized at its peak vaporization temperature, thereby maximizing the number of atoms vaporized without over-vaporizing an atomic source substance with a lower peak vaporization temperature and exhausting that atomic source substance too rapidly. This can be a significant advantage compared to alternative devices, wherein such devices vaporize multiple atomic species together from a combined atomic source substance, causing interference between atomic species and little control over ion volume, ion excitation, or selection of one ion type from another.

Device 201 in FIG. 2 also illustrates multiple loading areas 202-1 and 202-2 (although two are illustrated, an ion trapping device or system could have more than two ovens and/or loading areas), and a plurality of electrodes (e.g., direct current electrodes) 204 and 206 in a variety of configurations illustrated in FIGS. 2, 3, 4, and 5 to move the ions to particular trap locations within an ion trapping area. The trapping area in FIG. 2 includes two portions 203-1 and 203-2 and ions can be selectively moved to any of the many trap locations in either section, such as locations 205-1 and 205-2, from the loading areas 202-1 and 202-2 via junction 210.

Loading areas 202-1 and 202-2 may be provided, wherein the loading areas are physically separate from each other to allow ions of a particular type to be selected for a particular trap location (e.g., trap location 205-1, 205-2). The ion trapping device for trapping multiple ions with physically separate loading areas allows for physical separation of the atoms passing through the apertures of oven 100 into the loading areas 202 and 208 from one or more atomic source substances.

Using embodiments such as that shown in FIG. 2 can provide numerous benefits. For example, arranging multiple source substances proximal to multiple heating elements for multiple ovens and arranging multiple ion loading and trapping areas proximal to ovens with these source substances promotes enormous potential for separately vaporizing specific atomic species, selecting particular ions to be placed within particular ion trap positions, and controlling the ions within one or more ion traps.

The electrodes located at the loading areas keep the ions in the loading areas, aid in the selection of a particular ion, and/or assist in moving the selected ions out of the loading area and into the trap area, while the electrodes in the trap area assist in moving the ions to particular selected trap locations and in trapping the ions once they are positioned).

Such a system embodiment can function by having a first plurality of electrodes that are selectively charged to move an ion from an atomic source substance of a first atomic species from the first loading area to a first ion trap location within the ion trap area. A second plurality of electrodes that are selectively charged to move an ion of a second atomic source substance, from the second loading area within the same ion trapping area or a second ion trap location within the ion trapping area.

In such a system, ions from either of the loading areas can be moved to any trap location and, in some embodiments, one type of ion can be positioned at a particular location and then that ion can be removed and another ion of the same or a different type can be positioned at that particular location. As the ions are travelling from the loading area to their particular location, a controller can be used to control the charges on the electrodes proximate to the ion to move the ion along the path to the particular location.

As discussed in connection with FIGS. 1, 2, 3, and 4, managing the movement of ions of the same or different atomic species within the same trap at different loading zones may provide significant value for a multitude of industries.

For example, two particular atomic species may be heated via system 200 in FIG. 2, wherein two particular atomic source substances, are heated proximate to physically separate loading areas, such as a loading area at the top of FIG. 2 and one at the bottom of FIG. 2, or two different loading areas both located at the top or bottom of FIG. 2, or any other number of loading areas physically separated from each other. The orientation of the loading areas provides the ability to use a different oven, as described in system 400 of FIG. 4, to provide the opportunity to use different atomic species requiring, preferring, or optimizing using different vaporization temperatures, as explained in conjunction with FIGS. 1 and 2.

By vaporizing at different temperatures, and heating at different, physically separate loading areas, a higher degree of management over the introduction of ions into an ion trap area can be exhibited. Also, the managed interaction of multiple ions with different ionic properties and differing state values may provide the ability to manage behavior of such ions (e.g. electric, magnetic, or photo-potential, or other attribute of an ion). Additionally, the managed interaction of multiple ions with similar ionic properties may allow a controller of such a system to manage the effects of such introduction on ions.

Such arrangements illustrate the flexibility of physical management of ions and the desirability to create intersecting zones wherein ions may interact in a predetermined or controlled manner, providing more predictability and allowing more storage capability and mobility of ions than in previous devices or systems.

System 200 may also be arranged wherein first and second loading areas, 202-1 and 202-2 are positioned such that the particular ion trap location 205-1 can be filled by either the first or the second atomic species. With ion traps, it may be desirable to be able to transport ions along different paths, and present those ions with a two-way junction 210. At the junction, the ions are able to take either path.

Figure 3:
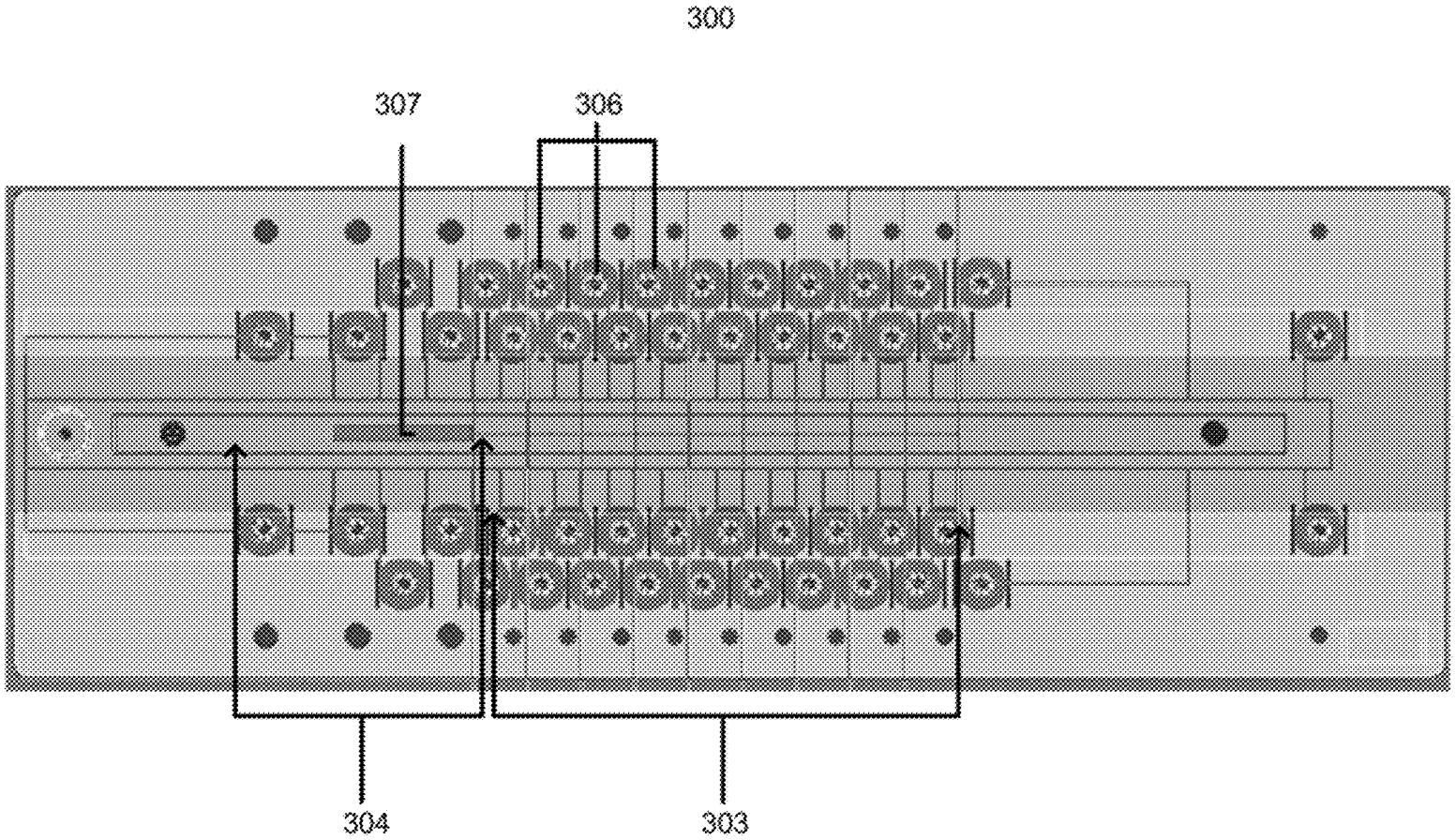
FIG. 3 illustrates a top detailed view of an ion trapping device, oriented proximal to an atom emitting oven and including a loading area and a plurality of electrodes selectively charged to move an ion to a particular ion trap location in accordance with one or more embodiments of the present disclosure.

FIG. 3 illustrates a top detailed view of an ion trapping device, oriented proximal to an atom emitting oven and including a loading area and a plurality of electrodes selectively charged to move an ion to a particular ion trap location in accordance with one or more embodiments of the present disclosure. As shown, the portion of the ion trap includes an opening 307, with an oven associated with the opening such that atoms can pass from the oven, through the opening, and into the loading area 304.

The embodiment of FIG. 3 also includes a plurality of electrodes 306, both at the loading area 304 and the trapping area 303. In such an embodiment, atoms emitted from an oven and ionized (e.g., oven 100 in FIG. 1) can enter an ion trapping area by passing through the opening 307 and into the loading area.

As shown in the embodiment of FIG. 3, ion trapping device embodiments can include an ion loading area 304 and a plurality of electrodes 306 for ion trapping. As previously discussed, one or more atoms can pass from an oven (e.g., oven 100 that can be positioned below opening 307 in the view of FIG. 3), as discussed previously in FIG. 1, into loading area 304.

The loading area 304 can be created with any suitable dimensions, depending on the design of an oven and expected ion volume to be held in the loading area at a particular time. The loading area 304 can be manufactured from a substrate, including, for example, a silicon substrate. The loading area 304 can be manufactured by etching a slot into a substrate (e.g., forming the ground plane of the ion trap), including, for example, a silicon substrate, through which atoms may pass.

Once an atom passes above the top surface of the ground plane, the atom is ionized and can be held in the loading area using electrical fields created by the electrodes 306. An ion can then be moved further into the ion trap to an alternative ion trap location by using an electrical well and varying electrical charges of electrodes 306 to urge the ion to move in a particular direction.

Figure 4:
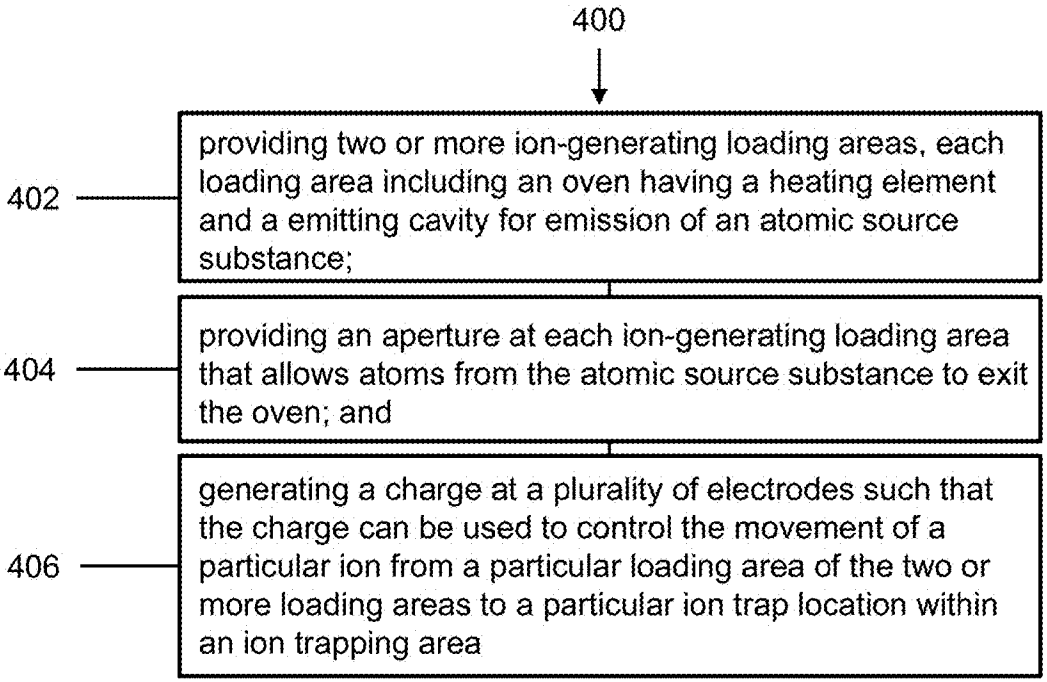
FIG. 4 illustrates a method for trapping multiple ions in accordance with one or more embodiments of the present disclosure.

FIG. 4 illustrates a method for trapping multiple ions in accordance with one or more embodiments of the present disclosure. FIG. 4 illustrates a method 400 for trapping multiple ions, comprising providing two or more ion-generating loading areas, each loading area including an oven having a heating element and a emitting cavity for the emission (e.g., via vaporization) of an atomic source substance, at 402.

The method also includes providing an aperture at each ion-generating loading area that allows atoms from the atomic source substance to exit the oven, at 404. The method also includes generating a charge at a plurality of electrodes such that the charge can be used to control the movement of a particular ion from a particular loading area of the two or more loading areas to a particular ion trap location within the ion trapping area, at 406.

Trapping multiple ions via physical devices and various oven and ion trapping system arrangements, as well as moving ions from different loading areas to specific locations within an ion trap; as described in conjunction with FIGS. 1-4; provides increase device and system flexibility with, efficiency for, and control over atom vaporization, and ion trapping and management.

The method illustrated in FIG. 4 can also include, wherein the method includes receiving, in the emitting cavity located superior to the heating element, an atomic source substance. While in some embodiments, an atomic source substance could be received in a variety of positions, receiving the atomic source substance superior to the heating element allows for use of gravitational force to hold the atomic source substance on a given substrate, minimizing substance loss and allowing for effective vaporization through substrate apertures, as described in conjunction with FIG. 1.

The method illustrated in FIG. 4 additionally can include providing each loading area with an oven having a different temperature set point. Providing a particular oven proximal to a particular loading area allows for ions to be physically separated. But, in some embodiments, placing ovens of a particular set point allows for efficient use of oven energy and atomic source substance, while also providing greater control over the vaporization volume of a particular atomic source substance at a particular oven set point.

The method illustrated in FIG. 4 can also include providing the two or more ion-generating loading areas wherein each area includes an oven located inferior to one or more cavities. Modern atomic source ovens, as known to those skilled in the art, can be quite large in size.

Furthermore, complex ion traps may involve several ion traps connected together, requiring heating of atomic source substance that may move into one or more loading zones for a given oven. Placing an oven inferior to one or more cavities, where ions may be effectively moved in a particular direction to one or more loading areas provides the ability to potentially service multiple ion traps with fewer ovens.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A planar ion trapping device for trapping multiple ions, comprising:

an ion trapping area including two or more ion loading areas, wherein each ion loading area includes an aperture that extends through the ion loading area in a direction perpendicular to a planar exterior surface of the device;

two or more ovens wherein each oven includes a heating element and a cavity for emitting uncharged atoms of a particular atomic species from an atomic source substance, wherein each oven is positioned below a different one of the apertures of the two or more ion loading areas within the ion trapping area, and wherein uncharged atoms emitted from each of the atomic source substances of the two or more ovens exit each of the two or more ovens, pass through one of the apertures of the two or more ion loading areas, pass above the planar exterior surface of the device, and become ionized above the planar exterior surface of the device; and a plurality of electrodes on the planar exterior surface of the device and oriented in a same direction, configured to be charged to:

trap a particular ion in a potential well exterior to the ion trapping device and above the planar exterior surface of the device; and selectively control the movement of the particular ion from one of the two or more loading areas to a particular ion trap location exterior to the ion trapping device and above the planar surface of the device.

2. The device of claim 1, wherein each oven includes an independent controller for controlling the temperature of the respective oven.

3. The device of claim 1, wherein the cavity includes a substrate for application of an atomic source substance.

4. The device of claim 3, wherein the cavity further includes a guide material configured to direct the emitting atoms of a particular atomic species to one of the apertures of the two or more ion loading areas within the ion trapping area.

5. The device of claim 2, wherein a first oven of the two or more ovens is controlled to reach a higher vaporization temperature than a second oven of the two or more ovens.

6. The device of claim 1, wherein a first oven of the two or more ovens may be used for vaporizing atomic species with cooling properties and a second oven of the two or more ovens may be used for vaporizing atomic species to perform logic functions.

7. The device of claim 1, wherein the loading areas are physically separate from each other to allow ions of a particular type to be selected for a particular trap location.

8. A system for trapping multiple ions, comprising:

a first oven that heats a quantity of a first atomic source substance such that the first source substance emits uncharged atoms of a first atomic species from the quantity of first source substance that exit the oven, pass upwards through a first aperture in a planar exterior surface of an ion trap, wherein the first aperture extends in a direction perpendicular to a planar exterior surface of the ion trap, enter an ion trapping area exterior to the ion trap and above the first oven and the planar exterior surface of the ion trap at a first loading area;

a second oven that heats a quantity of a second atomic source substance such that the second source substance emits uncharged atoms of a second atomic species from the quantity of source substance that exit the oven, pass upwards through a second aperture in the planar exterior surface of the ion trap, wherein the second aperture extends in the direction perpendicular to the planar exterior surface of the ion trap, enter an ion trapping area exterior to the ion trap above the second oven and the planar surface of the ion trap at a second loading area, and become ionized via laser photoionization above the planar exterior surface of the ion trap;

a first plurality of electrodes on the planar exterior surface of the ion trap and oriented in a first direction that are selectively charged to:

trap an ion of the first atomic species in a potential well in the first loading area exterior to the ion trap and above the planar exterior surface of the ion trap; and move the ion of the first atomic species from the first loading area to a first ion trap location exterior to the ion trap and above the planar surface of the ion trap in an absence of any electrodes oriented in a second direction; and a second plurality of electrodes on the planar exterior surface of the ion trap and oriented in the first direction that are selectively charged to:

trap an ion of the second atomic species in a potential well in the second loading area exterior to the ion trap and above the planar exterior surface of the ion trap; and move the ion of the second atomic species from the second loading area to the first ion trap location exterior to the ion trap and above the planar surface of the ion trap or a second ion trap location exterior to the ion trap and above the planar surface of the ion trap in the absence of any electrodes oriented in the second direction.

9. The system of claim 8, wherein the first loading area is located on a first side of a set of trap locations and the second loading area is located on a second side of the set of trap locations.

10. The system of claim 8, wherein the first and second loading areas are positioned such that the particular ion trap location can be filled by either the first or the second atomic species.

11. The system of claim 8, wherein an ion of either the first or second atomic species can be moved from the first loading area or the second loading area and positioned in the particular trap location through use of at least one of its respective plurality of electrodes.

12. The system of claim 8, wherein the first loading area is oriented opposite to the second loading area with respect to the first ion trap location.

13. The system of claim 8, wherein the first loading area and the second loading area are positioned in two similarly situated branches of the system.

14. The system of claim 8, wherein the first ion trap location and the second trap location are positioned in a body of the system.

15. The system of claim 8, wherein the first loading area is oriented opposite to a second loading area.

16. The system of claim 8, wherein two particular atomic species are heated proximate to physically separate loading apertures.

17. A method for trapping multiple ions, comprising:

providing an ion trapping device having two or more ion-generating loading areas, each loading area including an oven having a heating element and an emitting cavity for emission of an atomic source substance;

providing an aperture above the oven that extends through each ion-generating loading area in a direction perpendicular to a planar exterior surface of the device that allows uncharged atoms from the atomic source substance to exit the oven, pass above a planar exterior surface of the ion trapping device, and become ionized above the planar exterior surface of the device; and generating a charge at a plurality of electrodes on the planar exterior surface of the ion trapping device and oriented in a same direction to:

trap a particular ion in the potential well exterior to the ion trapping device and above the planar exterior surface of the ion trapping device; and control the movement of the particular ion from a particular loading area of the two or more loading areas to a particular ion trap location exterior to the ion trapping device and above the planar surface of the device within an ion trapping area in an absence of any electrodes oriented in a different direction.

18. The method of claim 17, wherein the method includes receiving, in the emitting cavity located above the heating element, an atomic source substance.

19. The method of claim 17, wherein the method includes providing each loading area with an oven having a different temperature set point.

20. The method of claim 17, wherein the method includes providing the two or more ion-generating loading areas wherein each area includes an oven located below one or more cavities.

* * * * *